US005353451A

United States Patent [19]

Hsiung

[11] Patent Number: 5,353,451

[45] Date of Patent: Oct. 11, 1994

[54] PLAYPEN FRAME STRUCTURE

[76] Inventor: Yu-Kuang Hsiung, No.1-1 Hsi-Keng, Tsao Chiao Hsiang, Miao Li Hsien

[21] Appl. No.: 71,918

[22] Filed: Jun. 3, 1993

[51] Int. Cl.[5] ..... A47D 9/00

[52] U.S. Cl. ..... 5/99.1; 5/98.1; 16/325; 16/326; 403/325

[58] Field of Search ..... 5/98.1, 98.3, 99.1; 16/325, 326; 403/65, 163, 322, 325

[56] References Cited

U.S. PATENT DOCUMENTS

| | | | |
|---|---|---|---|
| 4,670,921 | 6/1987 | Avni et al. | 16/326 X |
| 4,688,280 | 8/1987 | Kohus et al. | 5/99.1 |
| 5,211,498 | 5/1993 | Huang | 5/99.1 X |
| 5,239,714 | 8/1993 | Huang | 5/99.1 |
| 5,243,718 | 9/1993 | Shamil | 5/98.3 X |
| 5,293,656 | 3/1994 | Chan | 16/326 X |

FOREIGN PATENT DOCUMENTS

| | | | |
|---|---|---|---|
| 412070 | 2/1991 | European Pat. Off. | 5/99.1 |

*Primary Examiner*—Michael F. Trettel
*Attorney, Agent, or Firm*—Pro-Techtor International

[57] ABSTRACT

A playpen frame structure comprises a rectangular top rail frame supported by four upright primary legs. The top rail frame comprises four rails, each constituted by two bar members pivotally connected to a mid-joint which allows the bar members to be rotatable about pivots mounted on the mid-joint. A retaining member is provided on each of the mid-joint to form a releasable retaining engagement with the two bar members to maintain the bar members in the expanded condition. The retaining member comprises release button for breaking the retaining engagement. There is also provided a reinforcement structure on the lower ends of the primary legs to hold the legs in position and thus avoid accident collapses of the legs. The reinforcement structure comprises four reinforcement bars respectively extending diagonally from the lower ends of the primary legs and pivotally connected to a central joint which is supported on the ground by secondary legs and two secondary reinforcement bars connecting between two adjacent diagonal reinforcement bars to firmly hold the diagonal reinforcement bars in position.

7 Claims, 7 Drawing Sheets

PLAYPEN FRAME STRUCTURE

FIELD OF THE INVENTION

The present invention relates generally to a playpen and in particular to a foldaway playpen frame structure.

BACKGROUND OF THE INVENTION

Playpens are space for safely taking care of young babies and there are lots of different designs of playpens available in the market. Some of the conventional playpens have a non-foldaway structure and thus occupying a great space when not in use. A foldaway playpen frame structure was developed to overcome the space problem. Such a foldaway playpen structure provides a saving in storage space when the playpen is not in use. Examples are Taiwan Patent Application Nos. 81208167 and 81208161. Both applications are filed under the name of the applicant of the present invention.

Conventional foldaway playpen frame structures comprise a collapsible top rail structure under which legs are pivotally secured at their upper ends. In the playpen of Taiwan Patent Application No. 81208167, there is provided a reinforcement structure pivotally mounted between the legs substantially at the lower ends thereof to more securely hold the legs in position. The problem of the reinforcement structure disclosed in the prior art Taiwanese patent is that once the reinforcement structure is accidently hit or struck, a sudden, undesired collapse of the playpen frame may occur. This may hurt the baby sitting therein.

In Taiwan Patent Application No. 81208161, a joint for connecting two bars in a collapsible manner to form a top rail is disclosed. The joint has a complicated and inefficient structure so that when folded, the playpen still occupies a large space. Further, the prior art joint is expensive due to the complication thereof.

A co-pending US Patent Application Ser. No. 08/032,133, filed on Mar. 16, 1993, still pending, under the name of the applicant of the present invention, discloses a foldaway playpen frame structure which although intended to overcome the previous problems, has a joint structure which is not very reliable.

It is therefore desirable to provide a foldaway playpen frame structure which overcomes the deficiencies of the conventional playpen structures.

SUMMARY OF THE INVENTION

It is an object of the present invention to provide a foldaway playpen frame structure of which each of the top rail is constituted by two bars pivotally connected to a common joint member wherein a releasable retaining member is provided to retain the two bars in the expanded position in a releasable manner to allow the playpen to be collapsed when not in use.

It is another object of the present invention to provide a foldaway playpen frame structure which comprises a reinforcement structure constituted by four diagonally-extending bar members which pivotally jointed on a central joint having legs extending to the ground to provide a more secure support to the baby sitting in the playpen and secondary reinforcement bars respectively connecting between two adjacent diagonal reinforcement bar members.

It is another object of the present invention to provide a foldaway playpen frame structure which comprises a joint structure which is much more reliable than the prior art joint structure and much easier in operation.

To achieve the above-mentioned objects, there is provided a playpen frame structure comprising a rectangular top rail frame supported by four upright primary legs. The top rail frame comprises four rails, each constituted by two bar members pivotally connected to a mid-joint which allows the bar members to be rotatable about pivots mounted on the mid-joint. A retaining member is provided on each of the mid-joint to form a releasable retaining engagement with the two bar members to maintain the bar members in the expanded condition. The retaining member comprises release button for breaking the retaining engagement. There is also provided a reinforcement structure on the lower ends of the primary legs to hold the legs in position and thus avoid accident collapses of the legs. The reinforcement structure comprises four reinforcement bars respectively extending diagonally from the lower ends of the primary legs and pivotally connected to a central joint which is supported on the ground by secondary legs and two secondary reinforcement bars connecting between two adjacent diagonal reinforcement bars to firmly hold the diagonal reinforcement bars in position.

BRIEF DESCRIPTION OF THE DRAWINGS

The above and other objects and advantages of the present invention will be readily apparent from the following description of a preferred embodiment taken in connection with the accompanying drawings, wherein.

DETAILED DESCRIPTION OF THE PREFERRED EMBODIMENT

Figure 1:
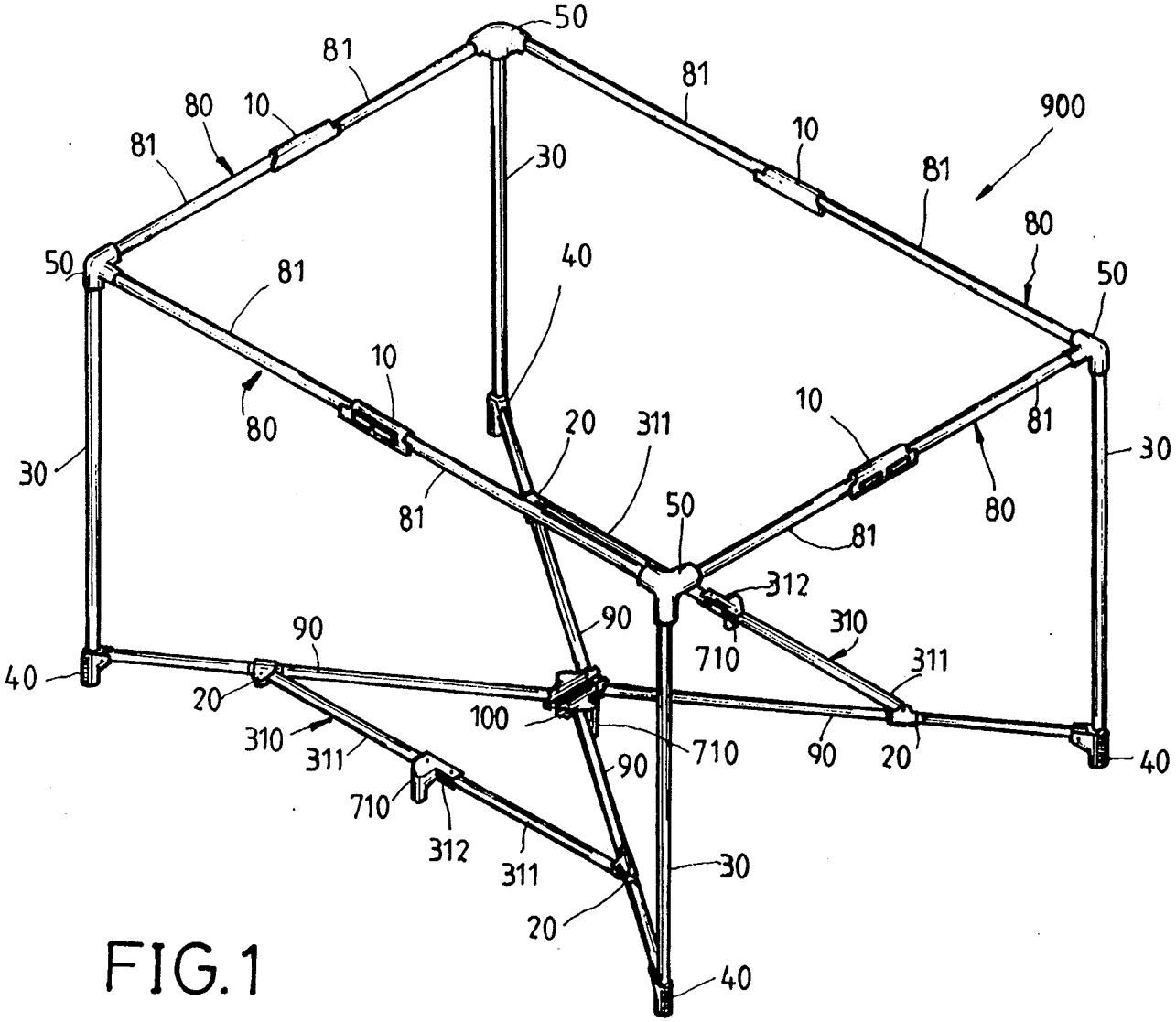
FIG. 1 is a perspective view showing a foldaway playpen frame structure made in accordance with the present invention, which is illustrated in an expanded condition.
Figure 2:
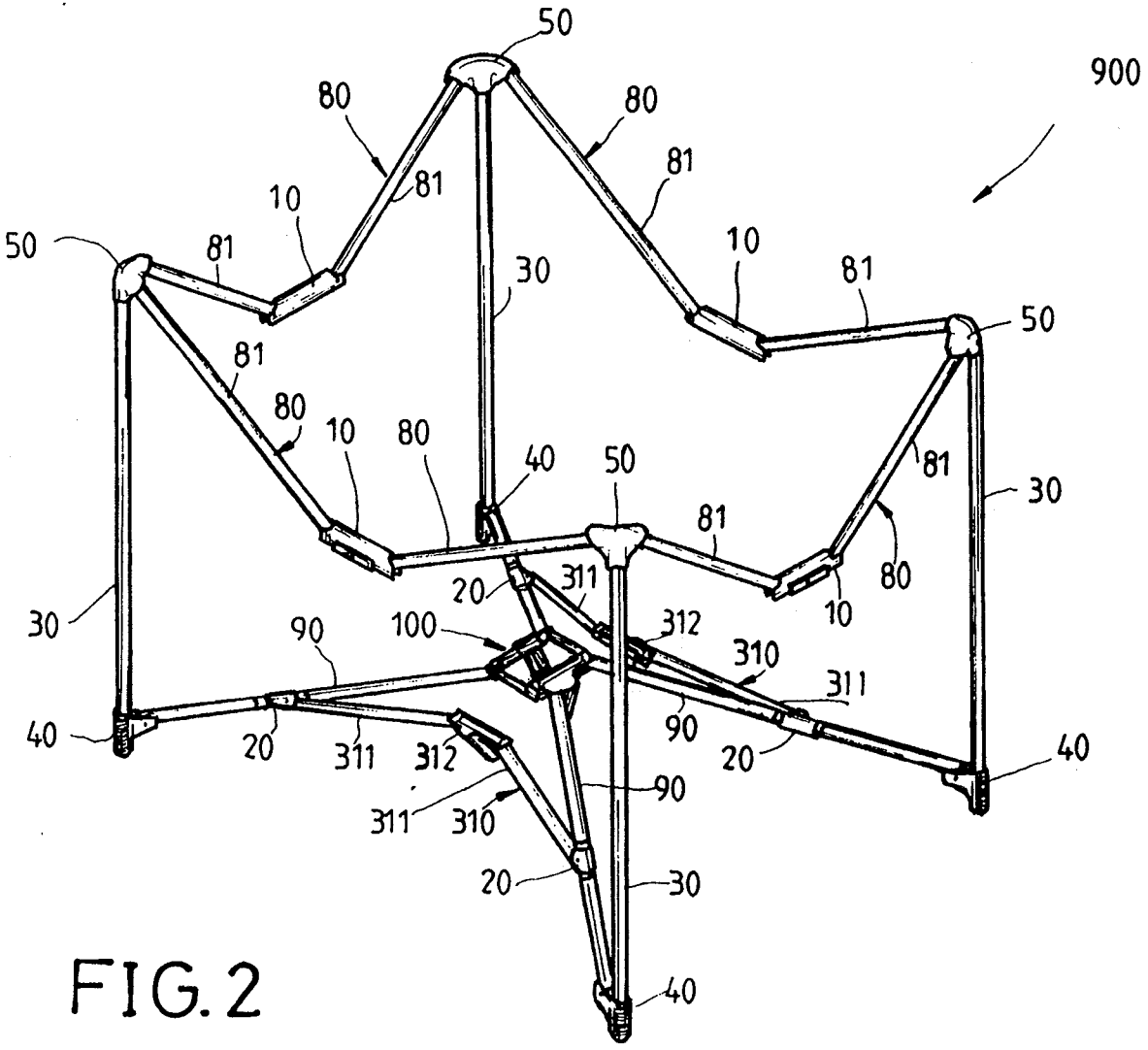
FIG. 2 is a perspective view showing the foldaway playpen frame structure of FIG. 1 in a partially collapsed condition.
Figure 3:
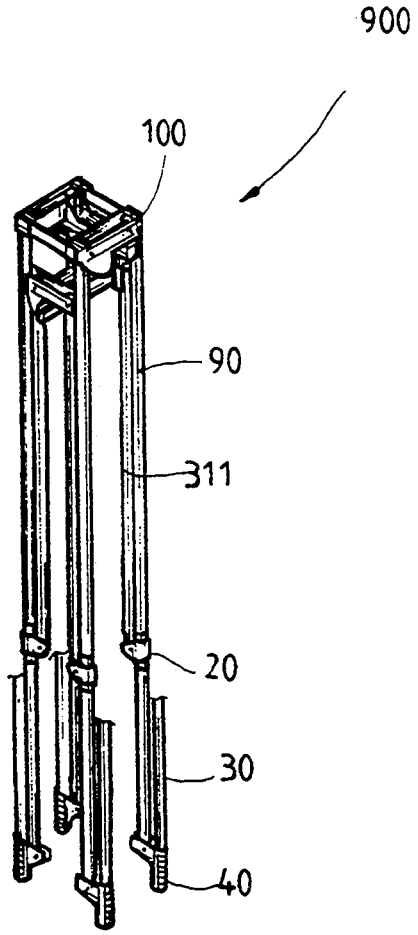
FIG. 3 is a perspective view showing the foldaway playpen frame structure of FIGS. 1 and 2 in a completely collapsed condition.
Figure 4:
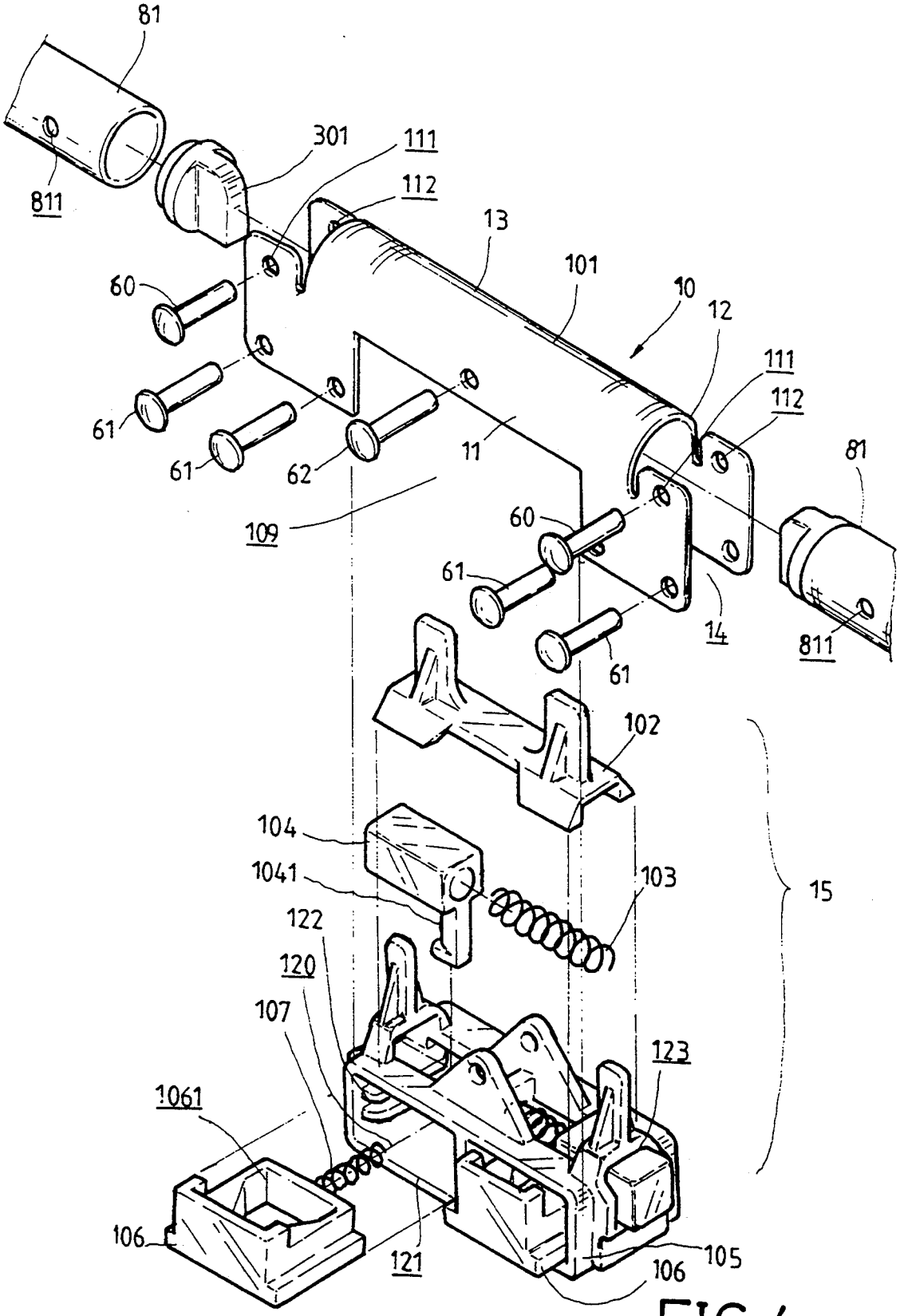
FIG. 4 is a partial perspective view, in a larger scale, showing in detail the structure of a mid-joint used in the playpen frame structure of the present invention.

With reference to the drawings and in particular to FIGS. 1, 2 and 3, wherein a foldaway playpen frame structure, generally designated with reference numeral 900, is shown respectively in the expanded, partially collapsed and fully collapsed conditions thereof, the playpen 900 comprises four top rails 80 defining, for example a rectangle, on the four corners of which four upright, elongated primary legs 30 are respectively mounted at the upper ends thereof. Pivotally secured on the lower end of each of the primary legs 30 is an elongated primary reinforcement bar 90 which is diagonally extending to pivotally connected at a remote end thereof to a central joint member 100 to form a diagonal reinforcement structure in order to maintain the primary legs 30 in a firm, non-movable relative to each other condition when the playpen is loaded. Two secondary reinforcement bars 310 are respectively connected between two adjacent diagonal reinforcement bars 90 in an opposite manner to provide an even stronger reinforcement structure.

Each of the top rails 80 is constituted by two elongated bar members 81 pivoted at a first end thereof to a mid-joint member 10 to be rotatable relative to each other so that when the bar members 81 are expanded to aligned with each other under the guide of the mid-joint member 10, a straight top rail 80 is formed. Also, each bar member 81 of top rails 80 is pivotally connected at a second end thereof, opposite to the first end, to a corner joint 50 which constitutes one of the four corners of the rectangle defined by the top rails 80 and to which the upper end of the respective primary leg 30 is pivotally secured to form the pivotal connection between the top rails 80 and the primary legs 30.

On the lower end of each primary leg 30, a ground support member 40 is securely mounted to support the primary leg 30 on the ground and to provide the pivotal connection between the diagonal reinforcement bar 90 extending from the lower end of the primary leg 30 and the primary leg 30 itself.

In the embodiment illustrated, the structure of the corner joints 50 and the ground support members 40 may be known to those having ordinary skills and not the features of the present invention so that no detail thereof will be further given herein.

According to a first aspect of the instant invention, there is provided a playpen frame comprising an improvement in the structure of the mid-joint members 10 which will be described in detail hereinafter with further reference to FIGS. 4–8.

With particular reference to FIGS. 4–8, wherein an embodiment of the mid-joint members 10 constructed in accordance with the present invention is shown, each of the mid-joint members 10 comprises a joint body 101 which is constituted by two side plates 11 and 12, preferably substantially parallel with each other, connected at a top side thereof with a semi-cylindrical portion 13, to define therein a space 14 for receipt of the first ends of the two bar members 81 connected thereto. Each of the two bar members 81 is pivotally secured between the two side plates 11 and 12 of the joint body 101 at an end thereof by means of a pivot 60 which extends through holes 111 and 121 respectively formed on the side plates 11 and 12 in an opposite fashion and a hole 811 formed on the first end of the bar member 81 to form the pivot connection therebetween. The two bar members 81 are thus opposite to each other with respect to the joint body 101.

Figure 5:
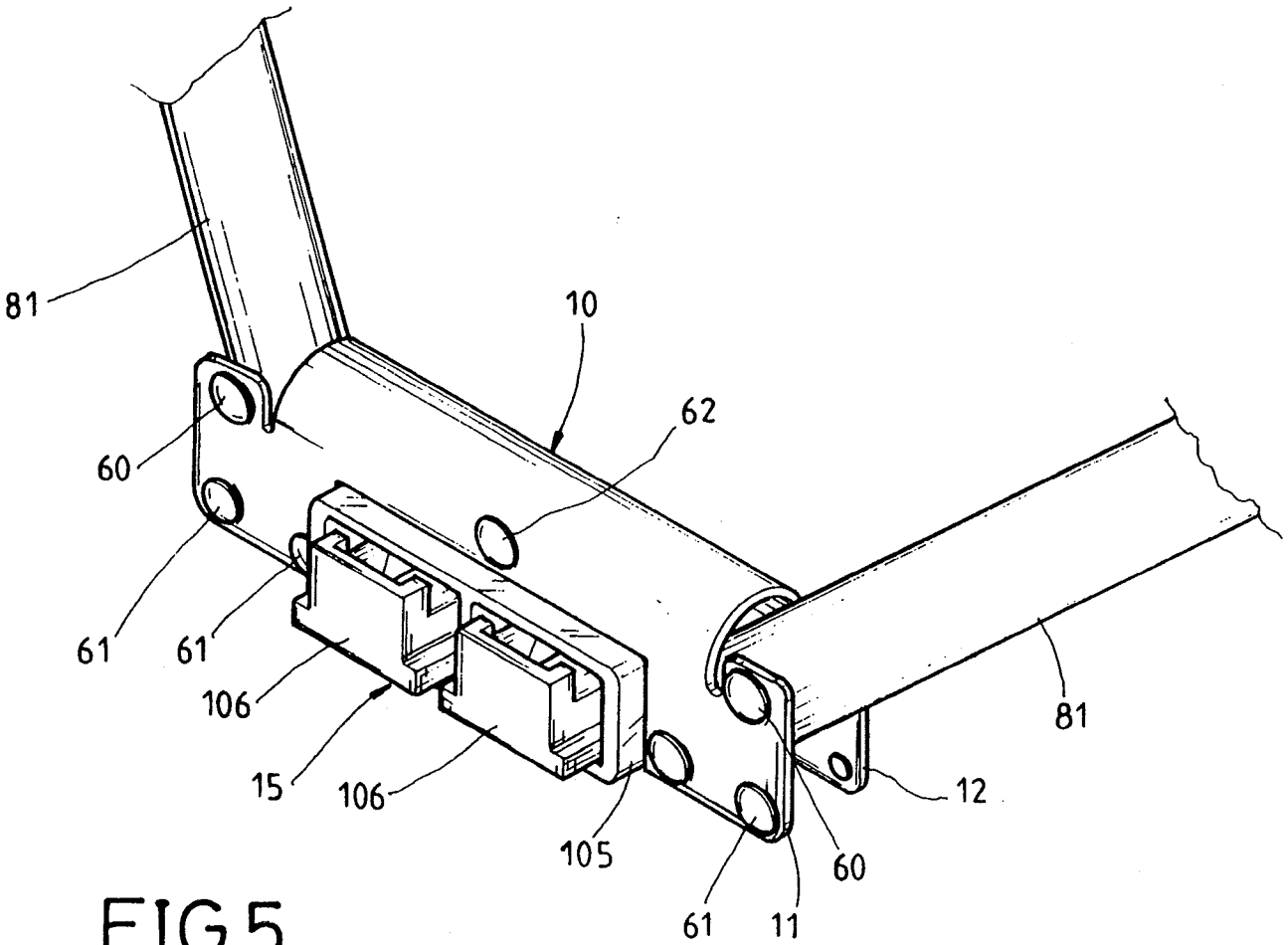
FIG. 5 is a partial perspective view showing the collapse of the mid-joint shown in FIG. 4.

Preferably, stop means is provided to limit the rotation of the bar members 81 to be only along a direction and thus preventing the bar members 81 from being rotated along an opposite direction. The stop means may comprise pins 61 extending between the side plates 11 and 12 at a location lower than the pivot pin 60 to allow the bar members 81 to be only rotatable toward the connection portion 13 of the mid-joint body 101, as shown in FIG. 5.

The mid-joint 10 further comprises releasable retaining means 15 mounted to the joint body 101 to retain the bar members 81 in the expanded position, as shown in FIG. 1. In accordance with a preferred embodiment of the present invention, the retaining means 15 comprises a base 105 having two partitioned chambers 120 symmetrically formed therein for respectively receiving a paw 104 and a release button 106.

Each of the chambers 120 has a front opening 121 and guiding rails 122 formed therein to allow the respective release button 106 to be movable, under the guide of the guiding rails 122, with respect to the base 105 and in and out of the front opening 121. The release button 106 is thus accessible from the front opening 121 to be depressible into the chamber 120 by the fingers of a user.

Each of the chambers 120 also comprises a side opening 123 to permit sideward movement of the respective paw 104 with respect to the chamber 104. The sideward movement of the paw 104 allows the paw 104 to partially protrude out of the chamber 120 to engage and thus retaining the respective bar member 81 in the expanded position. This will be further described hereinafter.

Preferably, on each of the side plates 11 and 12, a notch 109 is formed at a middle position between the two pivot pins 60 used to connect the bar members 81 to the joint body 101. The base 105 which is preferably substantially complemental in shape to the notches 109 is disposed and secured in the notches 109 by, for example, a pin 62 extending through both the side plates 11, 12 and the base 105. This allows the base 105 to be slightly rotatable with respect to the joint body 101.

Each of the paws 104 is biased by resilient means, such as a spring 103, to have an end portion thereof protrude out of the base 10 from the side opening 123 thereof when not acted upon by any other external forces. The paw 104 has a leg 1041 extending into a recess 1061 formed on the respective release button 106 which is also biased by resilient means, such as a spring 107, to have a portion thereof protrude out of the respective chamber 120 from the front opening 121. The recess 1061 comprises an inclined side wall 1062 (see FIG. 8) serving as a camming surface with the leg 1041 of the paw 104 as a follower member contactingly engaging the camming surface so that when the release button 106 is not depressed into the chamber 120 and thus is biased outward by the spring 107, the follower member 1041 of the paw 104 is located at such a position to allow the paw 104 to be biased by spring 103 to partially protrude out of the respective side opening 123, forming a retaining engagement with the bar member 81. This is illustrated at the left hand side of the drawings of FIGS. 6–8.

Figure 8:
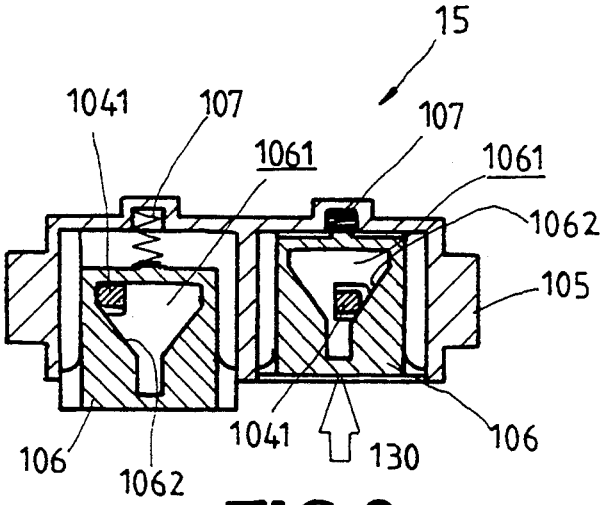
FIG. 8 is a cross-sectional view of the releasable retaining member shown in FIGS. 6 and 7.
Figure 6:
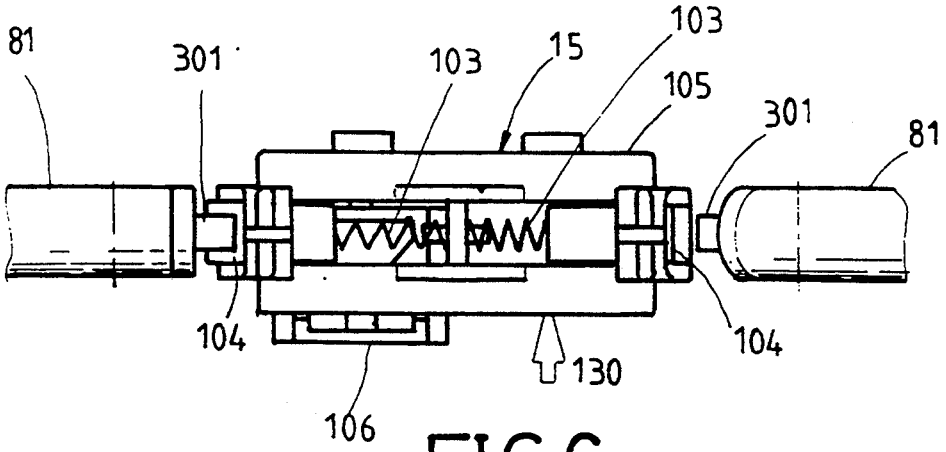
FIG. 6 is a top plan view showing a releasable retaining member used in the mid-joint of FIGS. 4 and 5 with the joint body removed for simplicity.
Figure 7:
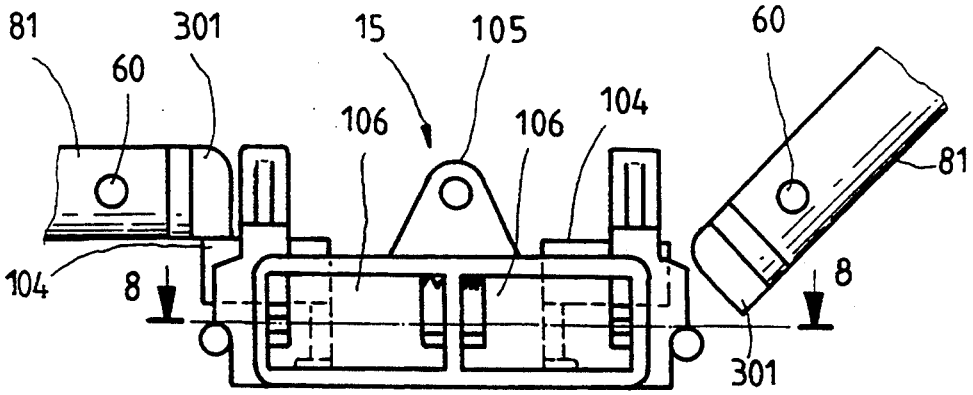
FIG. 7 is a side elevational view showing the releasable retaining member with the joint body removed for simplicity.

The right hand side of FIGS. 6–8 illustrates the condition when the release button 106 is depressed into the chamber 120 against the spring 107, along the direction denoted by arrow 130 of FIGS. 6 and 8.

When the release button 106 is depressed, the camming surface 1062 thereof acts upon the follower member 1041 of the paw 104 to move the paw 104 into the chamber 120 from the side opening 123 so as to break the retaining engagement between the paw 104 and the bar member 81, as illustrated in the left hand side of FIGS. 6 and 7. Once the retaining engagement is broken, the bar member 81 is allowed to rotate about the pivot pin 60, permitting the top rail 80 to be collapsed.

The retaining engagement between the bar member 81 and the paw 104 may be formed by providing an end member 301 secured on the first end of the bar member 81 to be abuttingly supported by the paw 104 which is biased to extend out of the side opening 123, as shown in the left hand side of FIGS. 6 and 7. The paw 104 is now serving as a stop which prevents the bar member 81 to be rotated about the pivot 60 along the direction to collapse the top rail 80. With the bar member 81 prevented from being rotated along either direction by the paw 104 and the pins 61, the bar member 81 is retained in the expanded position.

A cover 102 may be provided on the base 105 to more securely maintain the paws 104 movable within the chambers 120.

Turning back to FIGS. 1 and 2, the four diagonal reinforcement bars 90 which are respectively connected between the ground support members 40 and the central joint member 100 provides a number of secondary legs 710 extending therefrom to the ground to support, together with the ground support members 40 secured on the lower ends of the primary legs 30, the playpen 900 on the ground.

Figure 9:
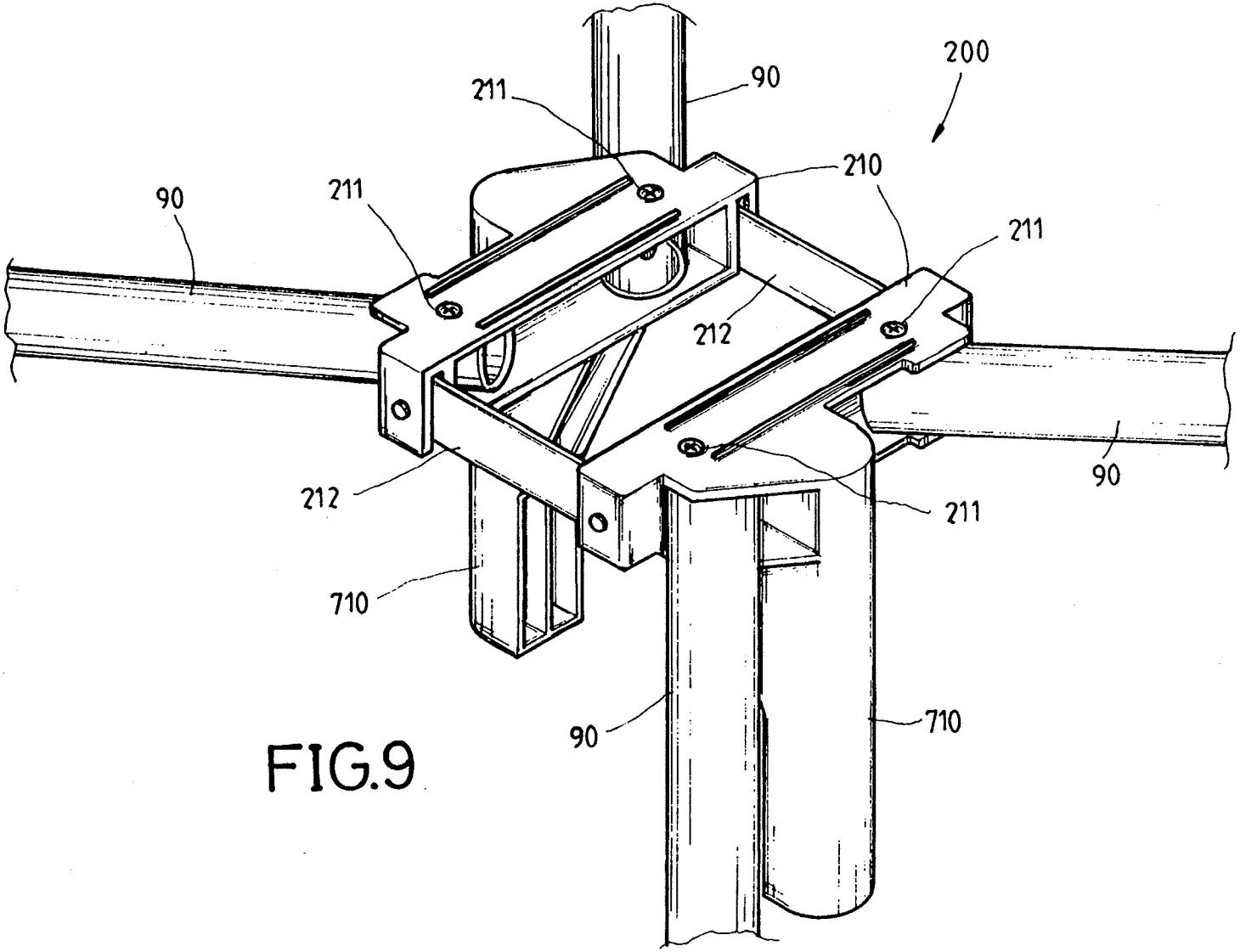
FIG. 9 is a partial perspective view, in a larger scale, showing in detail the structure of a central joint of the present invention.

Further referring to FIG. 9 wherein an embodiment of the central joint member 100 constructed in accordance with the present invention is shown, the central joint member 100 comprises two opposite side members 210, each having two of the four diagonal reinforcement bars 90 connected thereto by pivots 211 to allow the diagonal reinforcement bars 90 to be rotatable with respect to the side members 210 about pivoting axes substantially parallel with the legs 30. Each of the side members 210 has at least a secondary leg 710 mounted thereto to extend therefrom to the ground for supporting the side members 210 on the ground.

The two side members 210 are connected together by two opposite and spaced apart link members 212, each of which has two ends respectively pivoted to the two side members 210 to allow the side members 210 to be rotatable with respect to the link members 212 about pivoting axes substantially extending along a direction normal to the primary legs 30. Thus, the reinforcement structure comprised of the diagonal reinforcement bars 90 and the central joint member 100 is collapsible to be that shown in FIGS. 2 and 3.

With reference to FIGS. 1–3, each of the two secondary reinforcement bars 310 comprises two bar members 311 jointed by a fourth joint 312 in a pivot manner so as to allow the bar members 311 of the secondary reinforcement member 310 to be rotatable with respect to each other and with respect to the fourth joint 312 for collapsing the reinforcement structure constituted by the diagonal reinforcement bars 90, the central joint 100 and the secondary reinforcement bars 310.

Preferably, each of the fourth joints 312 is provided with a secondary leg 710 extending therefrom to the ground for the support of the secondary reinforcement bars 310 on the ground.

The structure of the fourth joint 312 may be any known structure so that a detail description is not needed herein.

As shown in the drawings, the secondary reinforcement bars 310 are respectively connected between two adjacent diagonal reinforcement bars 90 to firmly hold the diagonal reinforcement bars 90 and to prevent the diagonal reinforcement bars 90 from moving from the desired position shown in FIG. 1 with respect to the other parts of the playpen 900. The bar members 311 of the secondary reinforcement bars 310 are respectively connected to the diagonal reinforcement bar 90 in a pivot fashion via a connector 20 which is mounted to the diagonal reinforcement bar 90 at a suitable position.

It is apparent that although the invention has been described in connection with the preferred embodiment, it is contemplated that those skilled in the art may make changes to certain features of the preferred embodiment without altering the basic concept of the invention and without departing from the spirit and scope of the invention as defined in the appended claims.

What is claimed is:

1. A playpen frame structure comprising:

a rectangular top rail structure which is defined by four top rails pivotally connected by four corner joints to form a closed-loop structure; and four upright, elongated, primary legs corresponding to the corner joints, each having an upper end pivotally connected to an associated one of the corner joints and a lower end with a ground support member mounted thereon to support on the ground;

primary reinforcement bars each of which has a first end pivoted to one of the ground support members and diagonally extends therefrom to have a second end thereof pivotally connected to a common central joint;

each of the top rails comprising two elongated bar members having first ends pivotally connected to a common mid-joint and second ends connected to the corner joints, said mid-joint comprising a joint body having two side plates which are substantially parallel and connected together at a top side thereof by a connecting portion to define a space for receiving the first ends of the two elongated bar members therein, pivots being provided to secure the first ends of the elongated bar members to the joint body to allow the elongated bar members to be rotatable relative to the joint body between an expanded position and a collapsed position, said side plates each having a notch formed thereon in an opposite manner;

each of said mid-joints comprising retaining means which has a base disposed in the notches formed on the side plates of the joint body, said base having two partitioned chambers formed therein, inside each of which chambers a paw is disposed in a sideward movable manner and biased by first resilient means to partially protrude out of a side opening of the chamber to engage and abuttingly support the first end of one of the elongated bar members in the expanded position;

each of said mid-joints further comprising release means to move said paw against the first resilient means into the chamber to break the abutting engagement between the paw and the elongated bar member;

said central joint comprising two side members each having two of said primary reinforcement bars pivotally connected thereto to allow said two primary reinforcement bars to be rotatable relative to the side member about axes substantially parallel with the length of said primary legs, the two side members being connected together by two spaced-apart but parallel link members, each of said link members having two ends respectively pivoted to the two side members to allow said side members to be rotatable relative to the link members about axes substantially normal to the length of said primary legs.

2. A playpen frame structure as claimed in claim 1, wherein said release means comprises a release button disposed inside each of the two chambers of said base to be biased by second resilient means to partially protrude out of the respective chamber from a front opening of the chamber, the release button having a recess formed thereon for receiving therein an extension of one of the paws, the recess having an inclined side wall to serve as a camming surface contactable by the extension of the paw so that when the release button is forced into the chamber against the second resilient means, said camming surface moves the paw via the contact between the camming surface and the extension of the paw into the chamber against the first resilient means to break the engagement between the paw and the elongated bar member of the top rail structure.

3. A playpen frame structure as claimed in claim 2, wherein said second resilient means comprises a spring.

4. A playpen frame structure as claimed in claim 1, further comprising two secondary reinforcement bars respectively connected between two adjacent primary reinforcement bars in an opposite manner, each of the secondary reinforcement bars comprising two elongated members pivotally connected at first ends thereof to a common fourth joint, the two elongated members having second ends thereof pivotally connected to the primary reinforcement bars respectively via a connector.

5. A playpen frame structure as claimed in claim 3, wherein each of the fourth joints comprises at least a secondary leg extending therefrom to the ground.

6. A playpen frame structure as claimed in claim 1, wherein said first resilient means comprises a spring.

7. A playpen frame structure as claimed in claim 1, wherein each of the side members of said central joint comprises at least a secondary leg extending therefrom to the ground.

* * * * *